US009700160B2

(12) United States Patent
Kim Thi Pham

(10) Patent No.: US 9,700,160 B2
(45) Date of Patent: Jul. 11, 2017

(54) ORTHOPEDIC PILLOW FOR TREATMENT AND PREVENTION OF LUMBAR AND THORACIC SPINE DISEASES

(76) Inventor: Loan Kim Thi Pham, Ho Chi Minh (VN)

( * ) Notice: Subject to any disclaimer, the term of this patent is extended or adjusted under 35 U.S.C. 154(b) by 0 days.

(21) Appl. No.: 14/421,653

(22) PCT Filed: Jul. 9, 2012

(86) PCT No.: PCT/IB2012/053508
§ 371 (c)(1),
(2), (4) Date: Jul. 10, 2015

(87) PCT Pub. No.: WO2014/009772
PCT Pub. Date: Jan. 16, 2014

(65) Prior Publication Data
US 2016/0037945 A1 Feb. 11, 2016

(51) Int. Cl.
*A47G 9/10* (2006.01)
*A47C 20/02* (2006.01)

(52) U.S. Cl.
CPC ..... *A47G 9/10* (2013.01); *A47C 20/027* (2013.01)

(58) Field of Classification Search
CPC ..... A47G 9/10; A47G 9/1009; A47G 2009/1018; A47G 9/1081; A47G 9/109;
(Continued)

(56) References Cited

U.S. PATENT DOCUMENTS 2,880,428 A * 4/1959 Forsland ..... A47G 9/10 5/636
3,719,185 A * 3/1973 Hanes ..... A47G 9/10 5/630

(Continued)

FOREIGN PATENT DOCUMENTS

FR 2658709 8/1991
WO 2012/038846 3/2012

OTHER PUBLICATIONS

International Search Report for PCT Application No. PCT/IB2012/053508 issued Nov. 2, 2012.

(Continued)

*Primary Examiner* — Robert G Santos
(74) *Attorney, Agent, or Firm* — BN IP-Consulting LLC; Binh-An Nguyen

(57) ABSTRACT

An orthopedic pillow comprises a padded member which has a hard block fully inserted inside. The padded member is made of resilient materials. The padded member's shape is roughly similar to that of a rectangular or hexagonal block; however, if looked right from its right or left side, the padded member has a symmetric or asymmetric bell shape. The length of the long side of the padded member is roughly equal to an adult's body's width. The hard block is made of non-resilient material. The hard block is able to tolerate, without rupturing and/or deformation, the gravity force on a mass of about 140 kg with a shape and size similar to those of a person's body. The shape of the hard block and of the padded member are similar, and their dimensions are proportional. The length of the long side of the hard block is also roughly equal to an adult's body's width. Both the padded member and the hard block have a flat bottom side.

2 Claims, 3 Drawing Sheets

(58) Field of Classification Search
CPC .... A61H 1/008; A61H 1/0292; A61H 1/0296; A61H 2203/0456; A61F 5/00; A61F 5/01; A61F 5/04; A61F 5/042; A47C 20/02; A47C 20/027
USPC ... 5/633, 632, 630, 636, 639, 643, 645, 652; 606/240, 237; 128/845
See application file for complete search history.

(56) References Cited

U.S. PATENT DOCUMENTS 3,842,453 A * 10/1974 Redfield ..... A47G 9/10 5/636
4,731,891 A * 3/1988 Scheurer ..... A47K 3/001 5/636
4,876,755 A * 10/1989 Parrish ..... A47C 7/425 297/230.1
5,137,333 A * 8/1992 Chee ..... A47C 7/022 297/452.21
D343,756 S * 2/1994 Sher ..... 5/655
5,367,730 A * 11/1994 Sher ..... A47D 13/08 5/632
5,675,850 A * 10/1997 Schmitt ..... A61H 7/001 128/845
5,824,013 A * 10/1998 Allen ..... A61F 5/01 128/845
6,513,179 B1 * 2/2003 Pan ..... A47G 9/109 5/636
6,708,353 B2 * 3/2004 Han ..... A61F 5/01 5/630
6,952,848 B1 * 10/2005 Strunk-Fellows ..... A47G 9/10 5/636
6,973,691 B1 * 12/2005 Cordova ..... A47C 7/383 248/118
8,671,479 B2 * 3/2014 Huttner ..... A61G 7/05753 5/630
2003/0126684 A1 * 7/2003 Han ..... A47C 20/023 128/845
2004/0064893 A1 * 4/2004 Sharp ..... A47C 7/383 5/655.3
2005/0273935 A1 * 12/2005 Cordova ..... A47C 7/383 5/652
2008/0086818 A1 4/2008 Sramek et al.
2009/0259152 A1 10/2009 Nguyen
2011/0271451 A1 * 11/2011 Huttner ..... A61G 7/05753 5/630
2012/0179202 A1 * 7/2012 Pham ..... A61F 5/01 606/240
2013/0213407 A1 * 8/2013 Yang ..... A61F 5/01 128/845
2014/0047642 A1 * 2/2014 Pham ..... A47C 3/16 5/653
2015/0223611 A1 * 8/2015 Kim Thi Pham ..... A47C 3/16 5/653
2016/0037945 A1 * 2/2016 Kim Thi Pham ..... A47G 9/10 5/633

OTHER PUBLICATIONS

International Preliminary Report on Patentability issued Jan. 13, 2015.

* cited by examiner

ORTHOPEDIC PILLOW FOR TREATMENT AND PREVENTION OF LUMBAR AND THORACIC SPINE DISEASES

FIELD OF THE INVENTION

The present invention generally relates to a pillow, and in particular, to an orthopedic pillow used for treatment and prevention of lumbar and thoracic spine diseases.

BACKGROUND OF THE INVENTION

The spine carries all the weight of a person's body and head, and the constant pressure from this weight and bending, stretching, and rotating movements is what usually leads to many spinal diseases.

Lumbar spine is the most flexible segment of the movable part of the vertebral column. As a result of the bending backwards as well as the rotating movements, lumbar vertebrate changes normal structure and creates many health problems.

Among those, disc herniation and spondylolisthesis are popular ones. Flat-back syndrome and lumbar kyphosis also happen, but at a lower rate. Approximately 90% of disc herniations occur toward the bottom of the spine at L4-L5 or L5-S1, which cause pain in the L5 nerve or S1 nerve, respectively. A herniation in this area puts direct pressure on the nerve, which causes lumbar radiculopathy. Similar symptoms are observed when spondylolisthesis occurs.

Similar to lumbar spine, thoracic spine also faces degeneration problem, which leads to disc herniation and spondylolisthesis. However, thoracic spine faces kyphosis much more often.

Several attempts have been made to cure the diseases of lumbar and thoracic spine, some of which were artificial disc replacement, back bracing, therapeutic drugs, and chiropractic care. Artificial disc replacement is used when disc herniation happens; however, this method is not for everyone, especially not for those with osteoporosis, joint disease, and allergy to stainless steel. In addition, artificial disc replacement requires a discectomy, which may lead to other complications such as infection, excessive bleeding, and damages to nerves. A back brace may be used to support the spine in the case of spondylolisthesis, however, the brace is not able to push the vertebra back to its normal position. Drugs such as acetaminophen and NSAIDs can reduce pain; unfortunately, they are only temporary. In addition to the drugs' limited ability of treat spine diseases, they cause liver and kidney damage, gastrointestinal bleeding, and ulcers. Chiropractic care seems to be a safer option of the three treatments. Chiropractors use spinal effective manipulation techniques, such as instrument-assisted manipulation, to treat patients. However, in the process of treatments, there is a risk of putting excessive forces on the patient's spine that may lead to damaging it. On the other hand, if the chiropractors treat the diseases with safer thus much less intensive forces, the treatment period is normally lengthy. The treatment period is even prolonged given the fact that patients can only spend one to two hours a day with chiropractors. To treat the diseases safely and to shorten the treatment period, it becomes necessary to have a device that can replicate the safe forces applied by the chiropractors, and that is handy enough for patients to use it whenever needed in order to increase the treatment time each day, thus to shorten the treatment period.

There are many devices have been invented to provide support to lumbar and thoracic spine. However, most of them help prevent spine diseases but do not treat the diseases. U.S. Pat. No. 5,863,095 shows a lobed resilient lumbar pillow to support the lower back of a person. U.S. Pat. No. 5,551,752 shows a cushion for supporting the lumbar area of the back of a person. U.S. Pat. No. 6,823,549 shows a cushion for prevention and treatment of decubitus ulcers but not spine diseases. U.S. Pat. No. 4,502,170 provides a method for improving posture and relieving back pain but not treat spine diseases.

Given that, the present device has been invented to treat, not only to prevent, but also to be used on a daily basis for treatment of lumbar spine diseases including lumbar and thoracic disc herniation, spondylolisthesis, and thoracic kyphosis.

SUMMARY OF THE INVENTION

It is an object of the present invention to provide an orthopedic pillow that treats, and prevents, lumbar and thoracic spine diseases. These diseases include lumbar and thoracic disc herniation, spondylolisthesis, and thoracic kyphosis.

According to the invention, an orthopedic pillow for treatment of lumbar and thoracic spine diseases comprises a padded member and a hard block fully inserted inside the padded member. The padded member is made of resilient materials such as foam, rubber, or cotton. The shape of the padded member is roughly similar to that of a rectangular or hexagonal block if being looked in the front-to-back direction; however, if looked right from its right or left side, the padded member has a symmetric or asymmetric bell shape, whose bottom might be broader than the top to ensure stability. The length of the long side of the padded member is roughly equal to an adult's body's width.

The hard block is made of non-resilient material such as wood, polystyrene foam, or hard rubber. The hard block is able to tolerate, without rupturing or deformation, the gravity force on a mass of about 140 kg with a shape and size similar to those of a person's body. The shapes of the hard block and of the padded member are similar to each other, and their dimensions are proportional, having a symmetric bell shape when the orthopedic pillow is used for the thoracic spine or asymmetric bell shape when the orthopedic pillow is used for the lumbar region, in order to bend in compliance with the curve created by the lumbar and sacral bone. The length of the long side of the hard block is also roughly equal to an adult's body's width. Both the padded member and the hard block have a flat bottom side.

To use the pillow to treat lumbar and thoracic diseases including disc herniation, spondylolisthesis, and thoracic kyphosis, a person needs to be in supine position, and then puts the pillow under his back or chest so that the long side of the pillow is perpendicular to his spine. The pillow needs to be positioned right under the herniated disc, slipped vertebra, or kyphotic area. Under the gravitational force of the person's body, the hard block generates a vertical reaction force that gradually pushes the herniated disc or the slipped vertebra back to its normal position, or gradually adjusts the kyphotic thoracic spine back to its normal curve. The reason the hard block is made of non-resilient materials, instead of resilient materials, is not only to ensure that the reaction force is not absorbed excessively therefore its magnitude stays at a certain level but also to keep the reaction force always vertical and consistent in strength over time. The padded member is made of resilient materials to mildly absorb the person's body's gravitational force, therefore reducing the reaction force generated by the hard block, giving the person comfort when using the pillow.

As the top of the padded member and hard block is wider, at a certain ratio, than the top of the hard block, the width of the hard block is similar to the dimension of two thoracic vertebrae with regard to the symmetric bell shape or the width of this hard block is similar to five dorsal vertebra with regard to the asymmetric bell shape for lumbar, the padded member spreads the reaction force, reducing the pressure the pillow puts on a certain area of the person's body to the level that is adequate to treat the diseases while not damaging the spine. Furthermore, the height of the pillow is computed so that the magnitude of the gravitational force, the height of the pillow is computed to be nearly double the width thereof with regard to the hard symmetric bell block, in case of the hard asymmetric bell block, the height of the pillow is similar to the width of the pillow, therefore of the reaction force, is at the right level to treat the diseases, not too high to damage the spine or too low to reduce the treatment effect of the pillow.

BRIEF DESCRIPTION OF THE DRAWINGS

The invention will be better understood when consideration is given to the following detailed description thereof. Such description makes reference to the annexed drawings wherein.

DETAILED DESCRIPTION OF THE INVENTION

The present invention provides an orthopedic pillow that is used for treating and preventing lumbar and thoracic spine diseases including lumbar and thoracic disc herniation, spondylolisthesis, and thoracic kyphosis.

As shown in FIGS. 1-4, the pillow 100 comprises a padded member 200 and a hard block 300 fully inserted inside the padded member 200. The padded member 200 is made of resilient materials such as foam, rubber, or cotton. The padded member 200's shape is roughly similar to that of a rectangular or hexagonal block; however, if looked right from its right side or left side 202, the padded member 200 has a symmetric bell shape whose bottom 202B is broader than the top 202T to ensure stability. According to another embodiment, the padded member 200 has an asymmetric bell shape. The length of the long side of the padded member 200 is roughly equal to an adult's body's width.

The hard block 300 is made of non-resilient material such as wood, polystyrene foam, or hard rubber. The hard block 300 is able to tolerate, without rupturing and/or deformation, the gravitational force on a mass of about 140 kg with a shape and size similar to those of a person's body. The shapes of the hard block 300 and of the padded member 200 are similar, and their dimensions are proportional. The hard block 300 and the padded member 200 can have a symmetric or asymmetric bell shape, depending on the body regions: the symmetric bell shape is used for the thoracic spine, the asymmetric bell shape is used for the lumbar region, in order to bend in compliance with the curve created by the lumbar and sacral bone. The length of the long side of the hard block 300 is also roughly equal to an adult's body's width.

Figure 1:
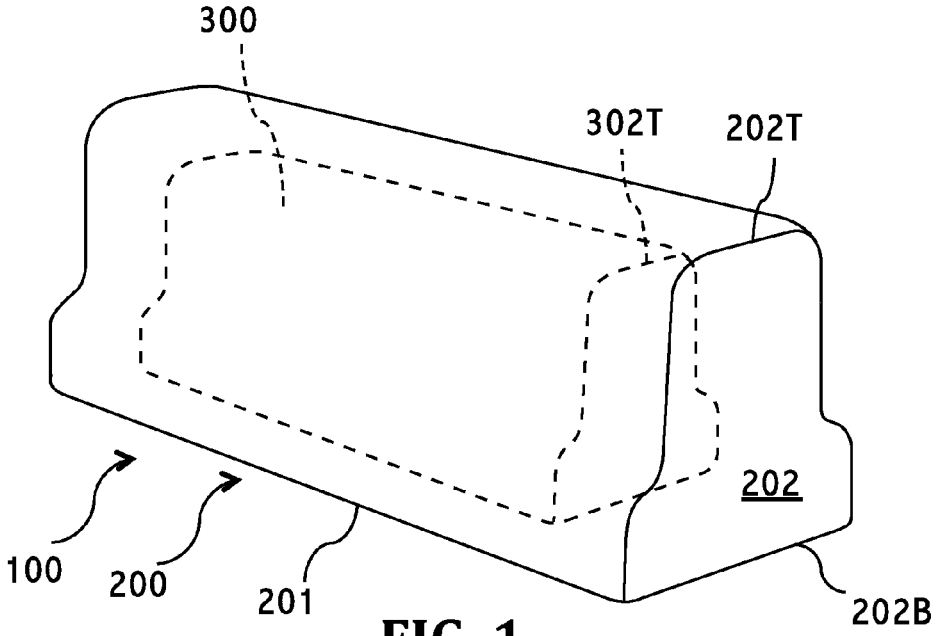
FIG. 1 is a right perspective view of an orthopedic pillow for treatment and prevention of lumbar and thoracic diseases according to the invention.
Figure 2:
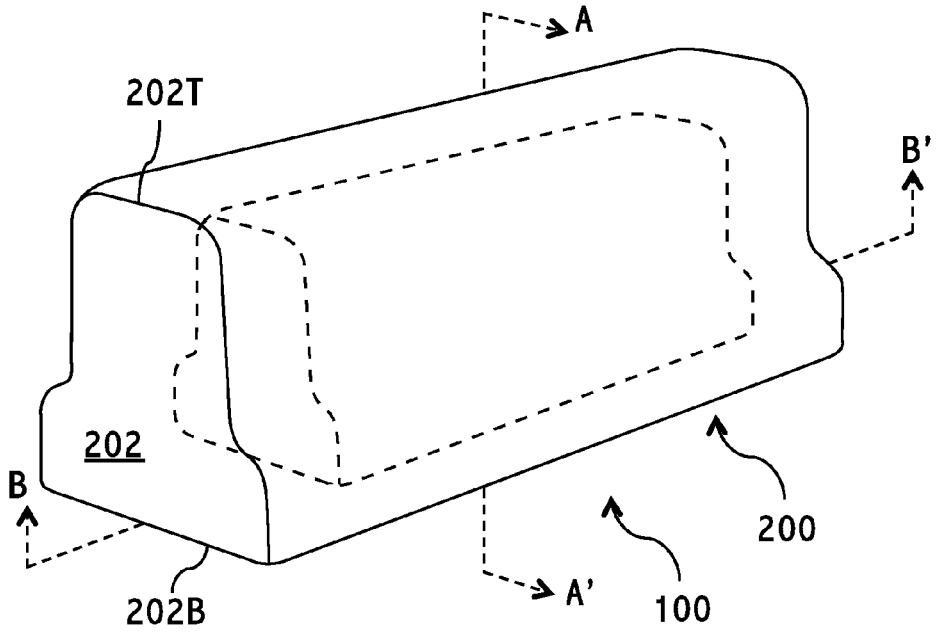
FIG. 2 is a left perspective view of the pillow shown in FIG. 1.
Figure 3:
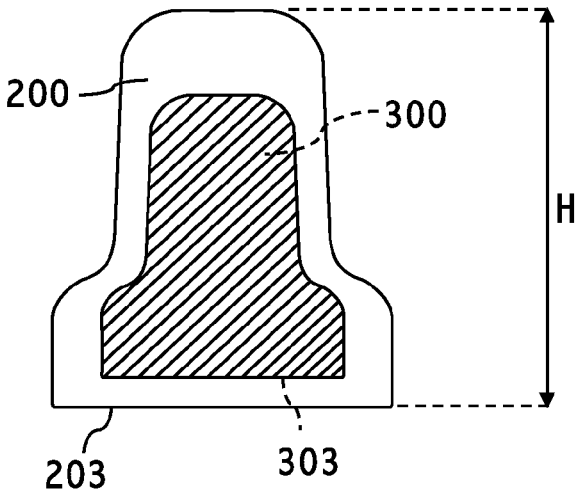
FIG. 3 is a cross-sectional view of the pillow of FIG. 1 along the line A-A' shown in FIG. 2.
Figure 4:
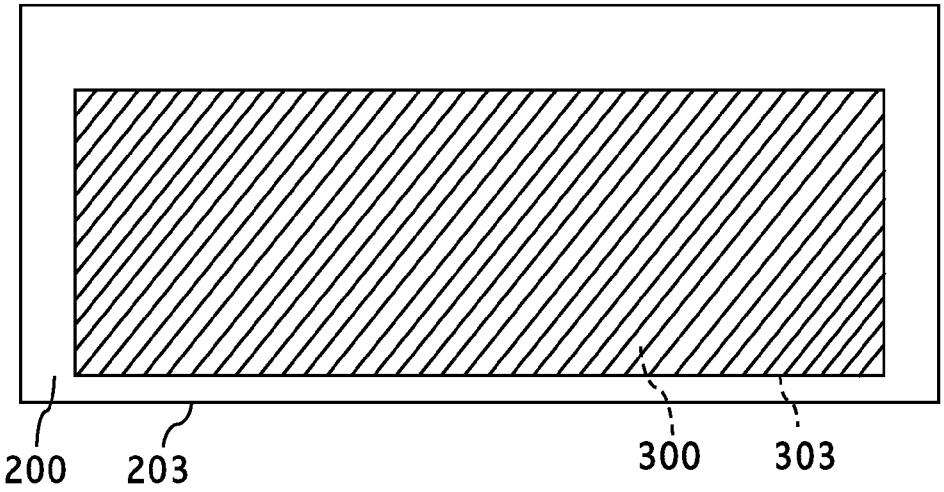
FIG. 4 is a cross-sectional view of the pillow of FIG. 1 along the line B-B' shown in FIG. 2.

Both the padded member 200 and the hard block 300 have flat bottom sides 203 and 303, respectively, as shown in FIG. 3.

Figure 5:
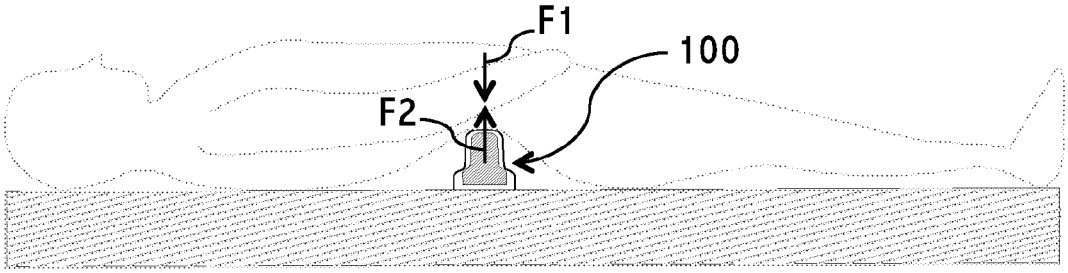
FIG. 5 illustrates how to use the pillow of FIG. 1.

FIG. 5 illustrates how to use the pillow 100. To use the pillow 100 to treat lumbar and thoracic diseases including disc herniation, spondylolisthesis, and thoracic kyphosis, a person needs to be in supine position, and then puts the pillow 100 under his back so that the long side of the pillow 100 is perpendicular to his spine.

The pillow 100 needs to be positioned right under the herniated disc or slipped vertebra. Under the gravitational force F1 of the person's body, the hard block 300 generates a vertical reaction force F2 that gradually pushes the herniated disc or the slipped vertebra back to its normal position or gradually adjusts the kyphotic thoracic spine back to its normal curve.

The reason the hard block of a bell shape 300 is made of non-resilient materials, instead of resilient materials, is not only to ensure that the reaction force F2 is not absorbed excessively therefore its magnitude stays at a certain level but also to keep the reaction force F2 always vertical and consistent in strength over time. The padded member 200 is made of resilient materials to mildly absorb the person's body's gravitational force F1, therefore reducing the reaction force F2 generated by the hard block 300, giving the person comfort when using the pillow 100.

As the top 202T of the padded member 200 is wider, at a certain ratio, than the top 302T of the hard block 300, the width of the hard block is similar to the dimension of two thoracic vertebrae with regard to the symmetric bell shape or the width of this hard block is similar to five dorsal vertebra with regard to the asymmetric bell shape for lumbar, the top surface of the padded member 200 is wide enough to uniformly spread the reaction force F2 over a certain area of the spine in order to support the dorsal vertebrae without damaging the spine, the length of the hard block 300 inserted in the padded member 200 is similar to the width of an adult's back, thereby assisting the entire back seating back on this block. Furthermore, the height H of the pillow 100, as indicated in FIG. 3, is computed to be nearly double the width thereof with regard to the hard symmetric bell block, in case of the hard asymmetric bell block, the height of the pillow is similar to the width of the pillow, so that the magnitude of the gravity force F1, therefore of the reaction force F2, is at the right level to treat the diseases, not too high to damage the spine or too low to reduce the treatment effect of the pillow 100.

What is claimed is:

1. An orthopedic pillow for treatment and prevention of lumbar and thoracic spinal diseases and not for sleeping comprising: two parts of a padded member (200) made of resilient materials such as foam, rubber, or cotton, and a solid block (300) fully inserted inside the padded member (200) and made of high-strength materials;

wherein the padded member has height, and a rectangular flat bottom side having a length and a width, wherein the length is substantially greater than the height and the width, wherein the cross-section of the padded member has a symmetric bell shape or asymmetric bell shape whose bottom is broader than the top to ensure stability;

the length of the rectangular flat bottom side of the padded member (200) is configured so that an adult can lie comfortably on top;

the solid block is embedded within the padded member;

the shapes of the solid block and of the padded member are similar to each other, having a symmetric or an asymmetric bell shape in order to bend and create a forward curve of the lumbar (202T) and sacral bone (202B);

the solid block has a upper part (300) and a lower part (303), the width of the lower part is larger than the width of the upper part for keeping the solid block, from tilting, always straight; and a height of the solid block is configured so that the pillow creates a slope and bended back or thoracic forward when a user places his back or thoracic on the solid block.

2. The orthopedic pillow as claimed in claim 1, wherein the solid block is made of very hard material and has the ability to tolerate the high pressure without being broken so that the solid block has the capability to adjust the spine of the user when lying by the weight himself;

whereas the solid block is made of non-resilient materials instead of resilient materials not only to ensure that a gravitational force (F1) created by the user's weight pressing on the pillow is not absorbed excessively, thereby creates a vertical reaction force (F2) or feedback force equivalent to strong gravitational force (F1) but also to keep the reaction force always vertical and consistent in strength over time;

wherein the pillow (100) is capable of treating lumbar and thoracic diseases including disc herniation, spondylolisthesis, and thoracic kyphosis, and the pillow is configured such that the user can lie in a supine position, and place the pillow (100) in an upright position under his chest or his back so that the long side of the pillow (100) is perpendicular to his spine; and the pillow is configured such that under the gravitational force (F1) of the user's body, the solid block (300) generates a vertical reaction force (F2) that is configured to gradually pushes a herniated disc or slipped vertebras back to a normal position or is configured to gradually adjusts a kyphotic thoracic spine back to its normal curve.

* * * * *